US006004431A

United States Patent [19]

Pantaleo

[11] Patent Number: 6,004,431

[45] Date of Patent: Dec. 21, 1999

[54] HEADBOX WITH ACTIVE LOCAL FLOW CONTROL

[75] Inventor: Scott B. Pantaleo, Beloit, Wis.

[73] Assignee: Beloit Technologies, Inc., Wilmington, Del.

[21] Appl. No.: 09/028,627

[22] Filed: Feb. 24, 1998

[51] Int. Cl.[6] ..... D21F 1/06

[52] U.S. Cl. ..... 162/259; 162/336; 162/343

[58] Field of Search ..... 162/198, 263, 162/336, 258, 259, 343

[56] References Cited

U.S. PATENT DOCUMENTS

| | | | |
|---|---|---|---|
| 2,904,461 | 9/1959 | Washburn et al. | 162/216 |
| 4,285,767 | 8/1981 | Page . | |
| 4,784,726 | 11/1988 | Evalahti | 162/216 |
| 4,888,094 | 12/1989 | Weisshuhn et al. | 162/259 |
| 5,183,537 | 2/1993 | Hegert et al. . | |
| 5,196,091 | 3/1993 | Hergert . | |
| 5,470,439 | 11/1995 | Makino et al. . | |
| 5,549,793 | 8/1996 | Hellstrom et al. . | |
| 5,560,807 | 10/1996 | Hauser . | |
| 5,626,722 | 5/1997 | Huovila | 162/343 |
| 5,707,495 | 1/1998 | Heinzmann et al. . | |
| 5,833,808 | 11/1998 | Shands et al. | 162/336 |

FOREIGN PATENT DOCUMENTS

| | | | |
|---|---|---|---|
| 89/11561 | 11/1989 | WIPO | 162/343 |

OTHER PUBLICATIONS

Shands et al., "Method of Controlling Curl Employing Inline Headbox Edge Control Valve," Patent Application 08/786, 626.

*Primary Examiner*—Karen M. Hastings

[57] ABSTRACT

A headbox employs flow control valves which modulate the flow of stock through each tube of a tube bank, to give greater control over the cross machine direction flow of stock to the forming section of a papermaking machine. In one approach the flow through the tubes making up the tube bank is controlled by rotating cylindrical valve members which extend into portions of the tubes making up the tube bank. The valve members have channels which align with the tubes when the valve is fully opened. Rotation of the control member obstructs the tubes in the column until the desired level of flow from that column of tubes is obtained. In a second approach, pinch valves are created by constructing part of the tube from an elastic material and using air pressure, a cam or a twisting action to reduce the flow through the elastic section thus creating an adjustable valve. A third method employs guillotine valves which selectively block the flow of stock through a column of tubes.

6 Claims, 5 Drawing Sheets

HEADBOX WITH ACTIVE LOCAL FLOW CONTROL

BACKGROUND OF THE INVENTION

1. Field of the Invention

The present invention relates to headboxes used in forming a paper web in general, and to headboxes employing adjustment mechanisms in particular.

2. Background of the Invention

Paper is made of individual fibers which are deposited in a continuous sheet. The sheet is typically formed from a papermaking stock consisting of less than 1 percent wood fibers dispersed in more than 99 percent water. The fibers and water are deposited onto a forming fabric, or between two forming fabrics, in the former section of the paper machine to form a continuous web of paper. The papermaking stock is first fed to a headbox which distributes the stock across the width of the forming fabric or fabrics on which the paper web is being formed. The headbox discharges the stock through a long narrow converging nozzle or slice which injects the stock onto the rapidly moving wire screen or between two screens. The fibers are retained on the fabric or wire surface while the majority of the water is drawn through the fabric or fabrics. The former may be a single wire horizontal former (Fourdrinier) or a two wire (twin wire) former. The paper web thus formed is pressed, dried and wound into reels. The reels of paper formed on the papermaking machine are then further processed to produce smaller rolls or sets of paper for printing. Individual sheets are also made which may be used in sheet-fed printing presses, in copy machines and in laser printers.

Because paper is made of individual paper fibers which are joined together during the pressing and drying process, the orientation of the fibers within the paper controls the physical properties of the paper. In particular, fiber orientation influences the strength and dimensional stability of the paper. It has been found that paper, when exposed to heat or moisture, will form more wrinkles or become wavy when the fibers are insufficiently uniform in fiber orientation. Exposing paper to heat or moisture causes the paper to shrink or expand. It is the nonuniformity of the dimensional changes which causes the paper to wrinkle or cockle. Nonuniformities in the paper are in turn caused by fiber alignment variations.

Printing presses, converting equipment and papermaking machines are increasing in speed. This means they are more sensitive to small instabilities in the paper web such as those caused by nonuniform dimensional changes in the paper. The instabilities can lead to web breaks or print quality problems. The printing industry in newspapers, magazines and books continues to use more and more color which results in more water or other liquids coming in contact with the paper web where they can release dried-in stresses which bring out the dimensional instability of the paper and cause it to wrinkle. At the same time, increased moisture decreases the paper strength making it more subject to breaking.

Further, the consuming public has come to expect not only more color printing but printing of higher quality. Slight cockling or warping of the paper can lead to unprinted areas. Where glossy paper is utilized, waviness or cockle results in nonuniform reflection which is distracting to the consumer.

The fact that a sheet or web of paper can become wavy upon exposure to moisture or heat has thus become of greater concern. Most processes which form an image upon paper employ heat or moisture. When paper in sheet form is processed through a photocopier, laser printer or printing press, warping of the sheet may cause it to jam the machine and cause a significant loss of productive time. When paper in the form of a continuous web becomes wrinkled, it is liable to break. Breakage of a web within a printing press, in a winder or on a coater causes downtime, as well as a significant loss of paper.

The problem of dimensional changes in finished paper is aggravated by the trend to use lower base weight paper to hold down paper costs. Lighter-grade papers are more subject to press breakage or jamming. A lighter grade of paper also means that for a given amount of moisture transferred by printing, particularly of colored images, a greater percentage of moisture is introduced into the paper. The increased productivity of modern equipment means that even limited downtime to clear a jam or rethread a broken web can have significant economic consequences in terms of lost production. Further, paper must lie flat for easier handling, loading and compact transportation.

By the time the paper web leaves the former, the orientation of the fibers is fixed. Influencing fiber orientation of the web after the headbox in the forming section is difficult and largely impractical. Thus if greater uniformity of fiber orientation is to be achieved, the adjustment must be accomplished in the headbox. Thus the headbox must not only avoid introducing undesirable flow variations, it must attempt to correct for problems arising in the former.

Various means for controlling flow and scale of the turbulence produced in a headbox between the stock input header and the slice gap or opening are known. One known type of headbox employs a bank of parallel tubes which employs small scale turbulence generators and pressure drop features to assure a more uniform flow of stock into the nozzle and from the slice opening onto the forming wire.

Various means have been employed to enable adjustments to be made to the tube bank flow, including chamfering the tubes or installing inserts in specified tubes. However, these adjusting means are shutdown modifications, requiring downtime which can have significant economic consequences in terms of lost production, and are often viewed merely as temporary methods, with no long-term significance.

These approaches are also susceptible to headbox cleanliness problems, such as clogging, and do not take into account other more dynamic factors that affect fiber orientation resulting from headbox cross flow tendencies, such as headbox header balance, slice lip profile and use of pond-side bleeds. In addition, such modifications increase the significance of predicting the optimum edge flow relationship during the design stage for each headbox, when exact operating details are unknown. U.S. Pat. No. 5,470,439 to Makino et al. shows a system of valves for adjusting the flow of stock from a headbox along the pond sides. The valves allow adjustments of the flow of stock by a flow rate controller which receives data such as the lip opening degree, wire velocity, cross directional basis weight profile data and the like. However, Makino et al. only allows adjustment of the flow at the ends of the headbox.

What is needed is a headbox which deposits a fiber mat of more uniform fiber orientation onto a forming fabric.

SUMMARY OF THE INVENTION

The tube bank headbox on this invention employs flow control valves which modulate the flow of stock through each tube to give greater control over the cross machine direction flow of stock to the forming section of a papermaking machine. Control is used to automatically or manually adjust stock flow to control fiber orientation in the web being formed. Control may be on a single tube or column of tubes, or a section of tubes may be ganged together and controlled as a group.

There are two basic approaches to controlling the flow through the tubes making up the tube bank. The first approach employs rotating cylindrical valve control members which extend into portions of the tubes making up the tube bank. The valve control members have channels which are aligned with the tubes in a column of tubes when the valve is fully opened. Rotation of the control member increasingly obstructs the tubes in the column until the desired level of flow from that column of tubes is obtained. This approach generally requires controlling the flow of an entire column of tubes simultaneously. This approach is similar to that used for headbox edge flow control valves as shown in U.S. application Ser. No. 08/786,626 to Shands et al., now U.S. Pat. No. 5,833,808 which is incorporated herein by reference.

The second approach employs pinch valves which are created by constructing part of the tube from an elastic material and using air pressure, a cam or a twisting action to reduce the flow through the elastic section, thus creating an adjustable valve. In another alternative embodiment, guillotine type valves are used to control flow through the tubes of the tube bank.

It is a feature of the present invention to provide a headbox which provides adjustability in the cross machine direction flow of stock.

It is another feature of the present invention to provide a headbox of simpler hydrodynamic construction with highly uniform flow.

It is a further feature of the present invention to provide a headbox for the manufacture of paper with better fiber orientation.

It is yet another feature of the present invention to provide a headbox which can be adjusted automatically of the basis of an instrument for detecting fiber orientation and a formed web.

Further objects, features and advantages of the invention will be apparent from the following detailed description when taken in conjunction with the accompanying drawings.

DESCRIPTION OF THE PREFERRED EMBODIMENT

Figure 1:
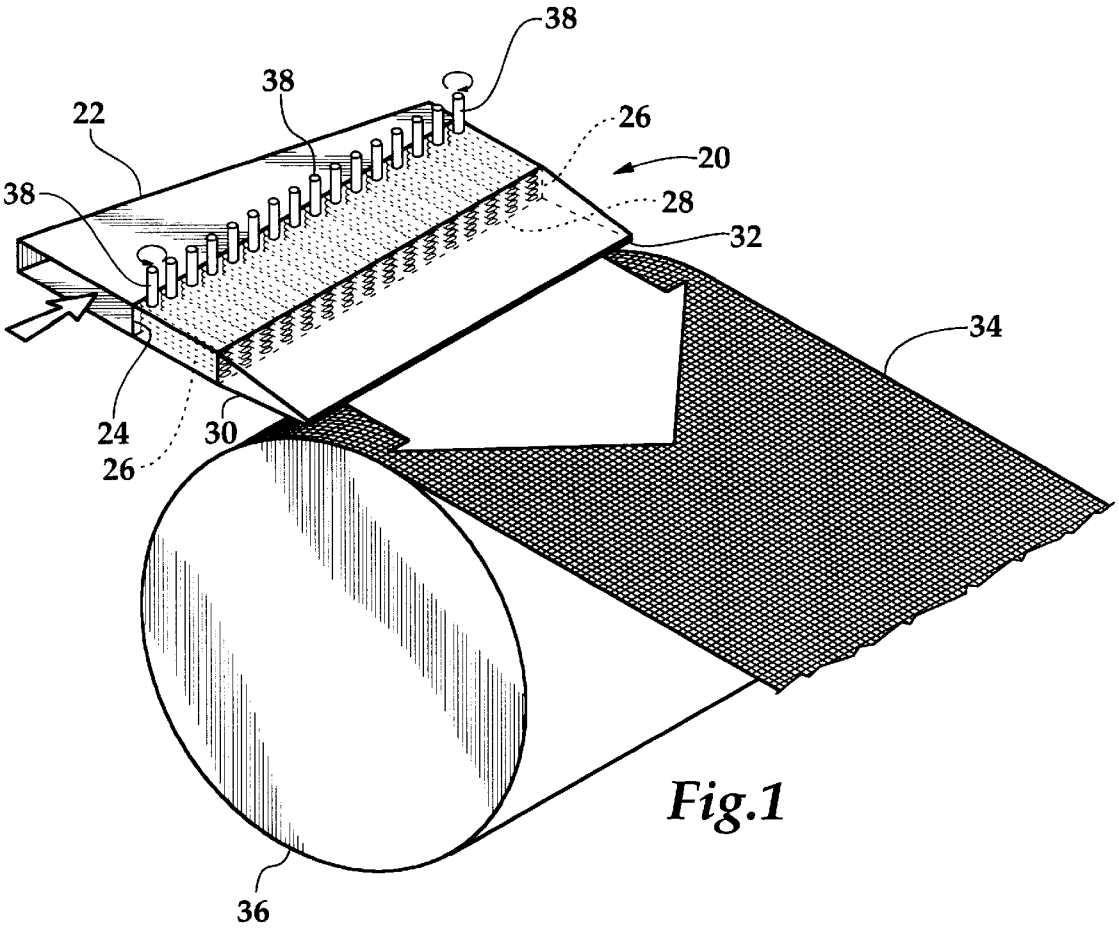
FIG. 1 is a schematic isometric side elevational view of the headbox with flow control of this invention.
Figure 2:
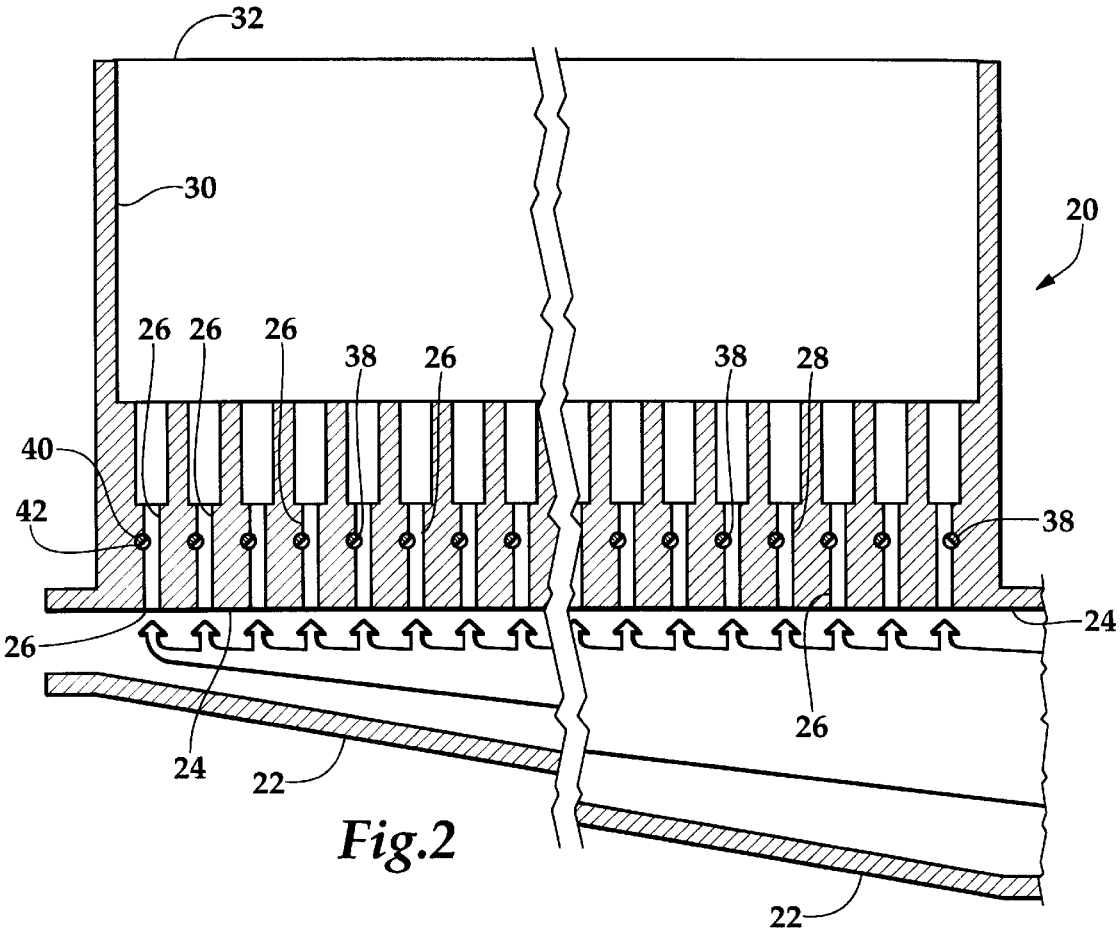
FIG. 2 is a plan cross-sectional view, partly cut-away, of the headbox of FIG. 1.

Referring more particularly to FIGS. 1–13 wherein like numbers refer to similar parts a headbox 20 is shown in FIGS. 1 and 2. The headbox consists of a header 22 which supplies papermaking stock along a discharge wall 24. Individual tubes of uniform size 26 open into the header 22 through the discharge wall 24. The tubes make up an array or tube bank 28 which supplies stock to a slice chamber 30 from which stock is injected through slice lip 32 onto a forming fabric 34 supported by a breast roll 36.

Figure 13:
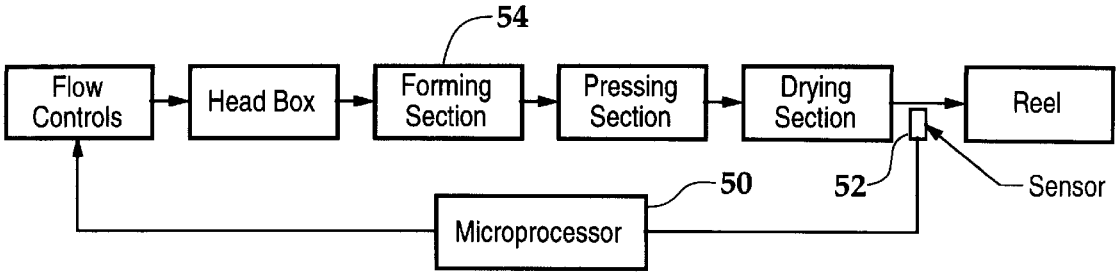
FIG. 13 is a schematic diagram of a papermaking machine incorporating a control system and a fiber orientation sensor.

The papermaking stock consists of approximately 99 percent water and 1 percent fiber. The water rapidly drains through the forming fabric becoming a mat of fibers which is pressed, dried and wound onto a reel, as shown in FIG. 13. Once the fiber is no longer fluid the orientation of the fibers within the paper web is fixed. Influencing fiber orientation in the forming section after the headbox is difficult and largely impractical. Thus if greater uniformity of fiber orientation is to be achieved, the adjustment must be accomplished in the headbox.

In the past the greatest concern was controlling basis weight, that is, fiber content, or web thickness in the cross machine direction, so that the paper formed was of a uniform thickness and weight. Problems associated with basis weight control were originally addressed by adjusting the slice opening across the machine direction by means of actuators which moved or bent the slice opening. This was improved on by controlling basis weight by injecting dilute stock into the headbox header along the discharge wall of the header.

Uniformity of stock supplied to the slice opening is controlled by careful design of the headbox header and the tubes making up the tube bundle. The header typically is designed to provide a uniform flow and pressure to all the tubes opening onto the discharge wall. The tubes are designed with a pressure drop to isolate downstream flow disturbances from upstream stock supply pressure variations. Generally, considerable success has been achieved by careful and detailed design of headboxes, but the design sophistication comes at some additional expense.

Figure 3:
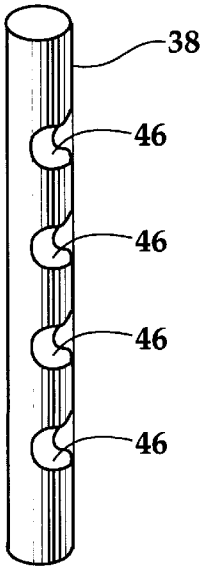
FIG. 3 is a side elevational isometric view of a valve member used in the headbox of FIG. 1.
Figure 4:
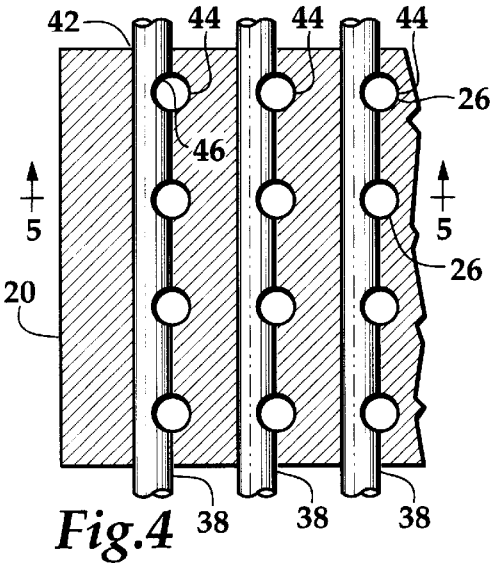
FIG. 4 is a schematic cross-sectional front elevational view of a valve member in the open position in the headbox of FIG. 1.
Figure 5:
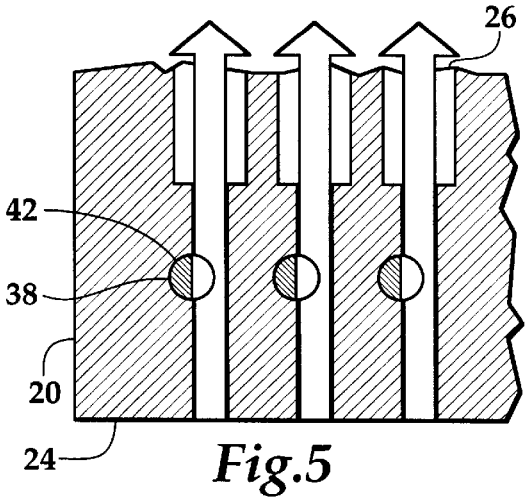
FIG. 5 is a cross-sectional plan view of FIG. 4 taken along section lines 5—5.
Figure 6:
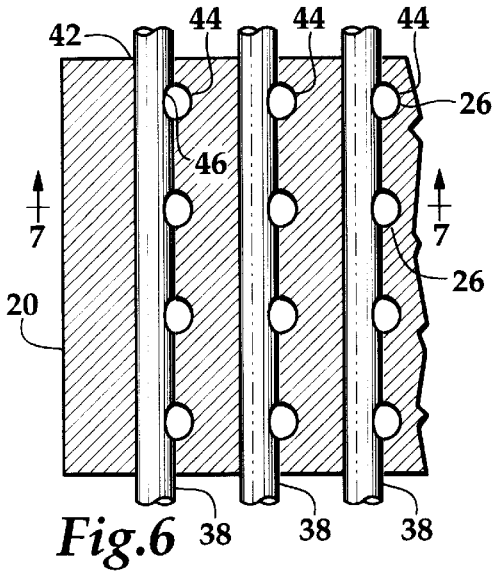
FIG. 6 is a schematic cross-sectional front elevational view of a valve member in a partly closed position in the headbox of FIG. 1.
Figure 7:
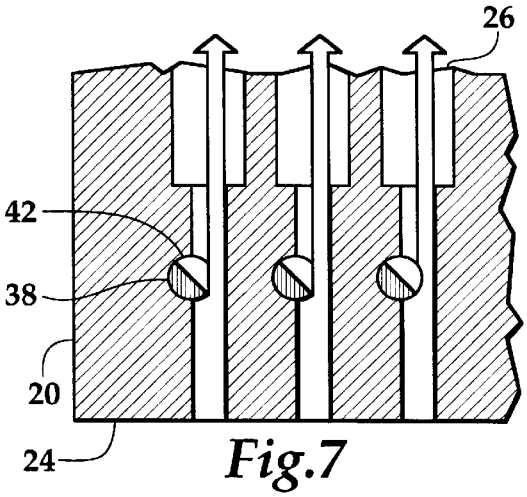
FIG. 7 is a cross-sectional plan view of FIG. 6 taken along section lines 7—7.
Figure 8:
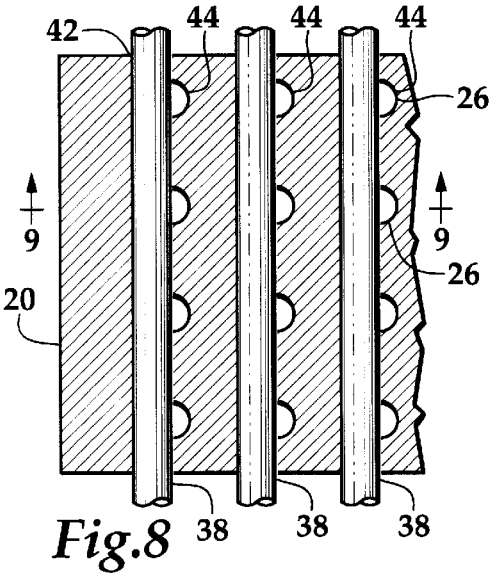
FIG. 8 is a schematic cross-sectional front elevational view of a valve member in a maximum closed position in the headbox of FIG. 1.
Figure 9:
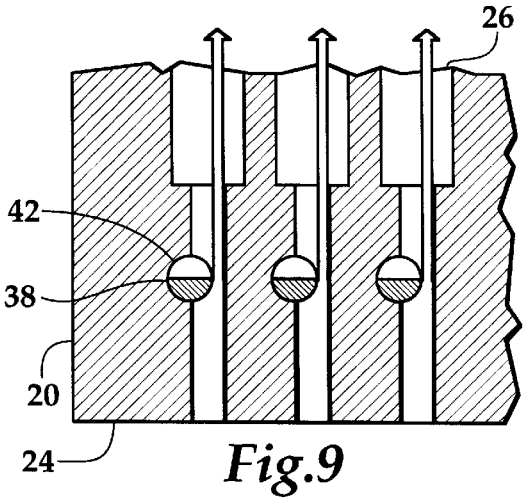
FIG. 9 is a cross-sectional plan view of the device of FIG. 8 taken along section lines 9—9.

The headbox 20 provides a new level of control by a plurality of valve members 38 which intersect and partly block each flow tube 26. The valves 40 are constructed by boring vertical holes 42 through the headbox which intersect a portion of each tube 26 in a column of tubes 44 as shown in FIGS. 4, 6 and 8. The valve members 38 are then drilled out, forming flow passages 46 as shown in FIG. 3. By rotating the valve members 38 as shown in FIGS. 4–9, the flow in each flow tube 26 can be partly occluded. The percentage on the total flow which the valve member 38 can block in each tube 26 is a design choice and could be more or less than shown in the figures.

A headbox 20 where flow into the slice chamber 30 is controlled along the entire cross machine direction allows adjustment of the flow into the slice chamber 30 and onto the forming fabric 34. Thus cross machine direction flows of stock on the forming fabric 34, which are largely responsible for fiber orientation problems, can be controlled by adjusting the valve members 38. Position of the valve members 38 is controlled by rotation. Each valve may be adjusted manually or multiple valves can be grouped together and adjusted by a common control (not shown) such as a chain or linkage connecting a given group of valves.

The valves 40 may be connected to a microprocessor 50 which controls each valve or group of valves spaced in the cross machine direction according to a selected valve control logic. That logic and control system may be based on off-machine tests and control logic arrived at from such tests. Alternatively if a practical profiling device 52, as shown in FIG. 13, becomes available which can detect fiber orientation, or a value correlated with fiber orientation, in real time on the machine, then the microprocessor 50 can adjust the valve members 38 in real time. The logic may be based on a physical model of the headbox 20 and forming section 54, or fuzzy logic which learns a control scheme over time, or a combination of both logics.

Figure 10:
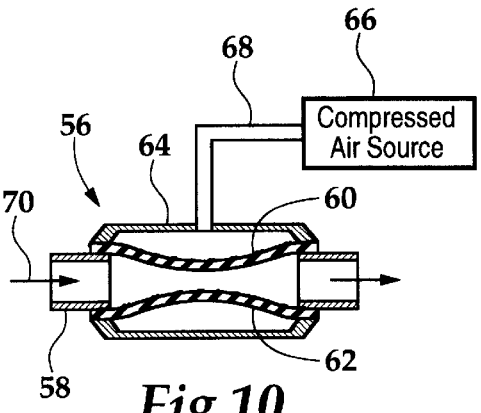
FIG. 10 is a side elevational view partly cutaway of an alternative means for adjusting the flow through individual tubes in a tube bank of a headbox.

An alternative valve 56 for use in a headbox is shown in FIG. 10. A flow tube 58 which connects a headbox header to a slice chamber has a portion 60 with an elastic wall 62. The elastic wall 62 is surrounded by an enclosure 64 which is sealed about the tube 58. Compressed liquid, such as compressed air, from a source 66 is supplied by a hose 68 to the enclosure 64. By introducing compressed air the elastic wall 62 of the tube 58 is compressed choking down the flow of stock 70 which can pass through the tubes 58.

Figure 11:
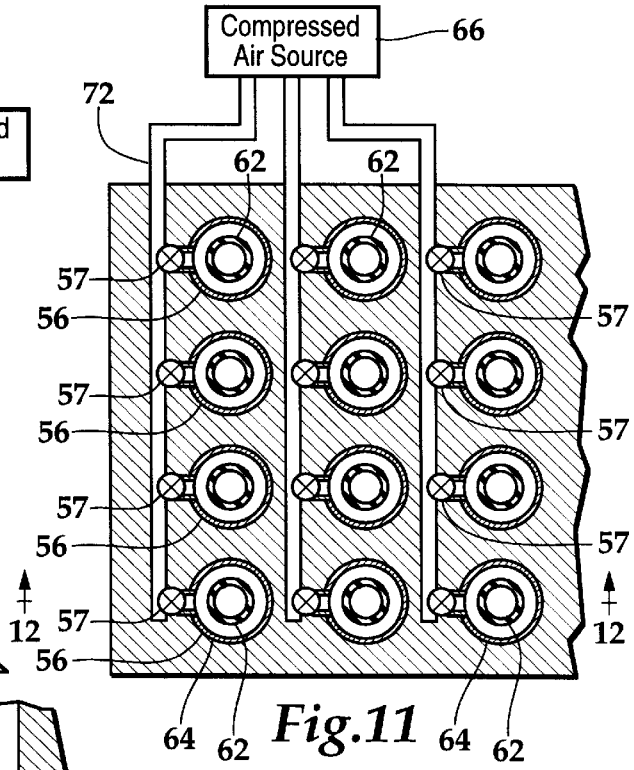
FIG. 11 is an elevational cross-sectional view of an alternative headbox of this invention taken along section line 11—11 of FIG. 12.

As shown in FIG. 11, an air manifold 72 can be connected to a column of alternative valves 56. Individual solenoid or mechanical valves 57 control the flow of air from the manifold 72 so that each tube 58 can be controlled independently of other tubes in a column of tubes. The valves 57 may be omitted and individual air manifolds may be controlled instead. The control of the valves 56 can be combined into various groups depending on the desired level of controllability.

Figure 12:
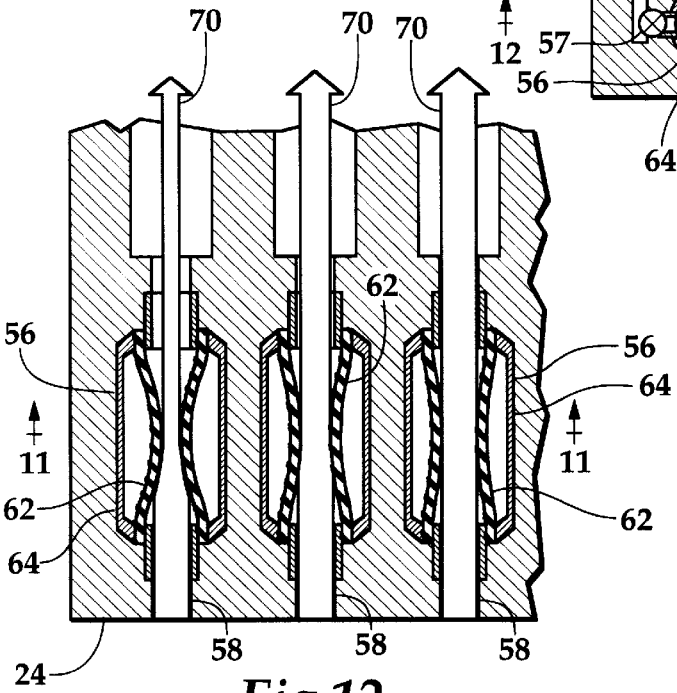
FIG. 12 is a cross-sectional plan view of the device of FIG. 11 taken along section line 12—12.

FIG. 12 shows how valves 56 are arranged to control the flow from tubes 58 in the cross machine direction.

It should be understood that various known ways of restricting flow in an elastic pipe could be used to restrict flow through the tubes 58. These known techniques include twisting a portion of the elastic tube, using a fluid other than air and using a mechanical cam to push against the elastic tube.

The valves 57 can be arranged in groups for manual or automatic control in a way similar to the control of the valve members 38.

Figure 14:
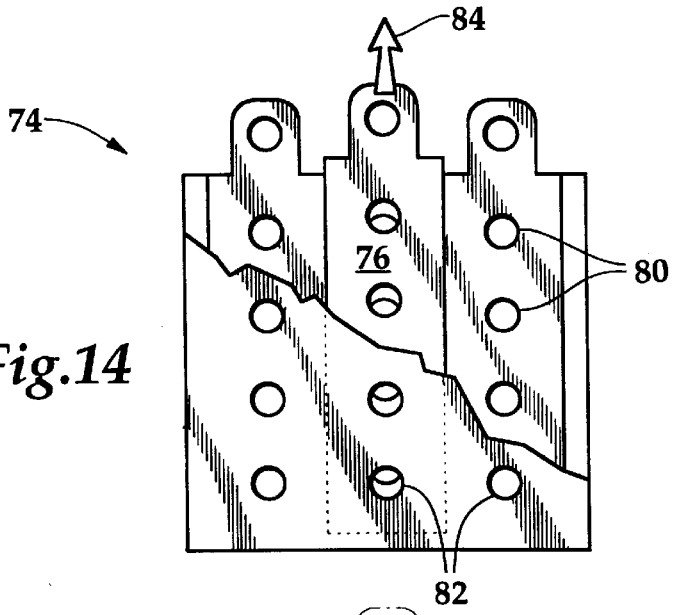
FIG. 14 is an elevational cross-sectional view of another alternative headbox of this invention employing guillotine type valves.
Figure 15:
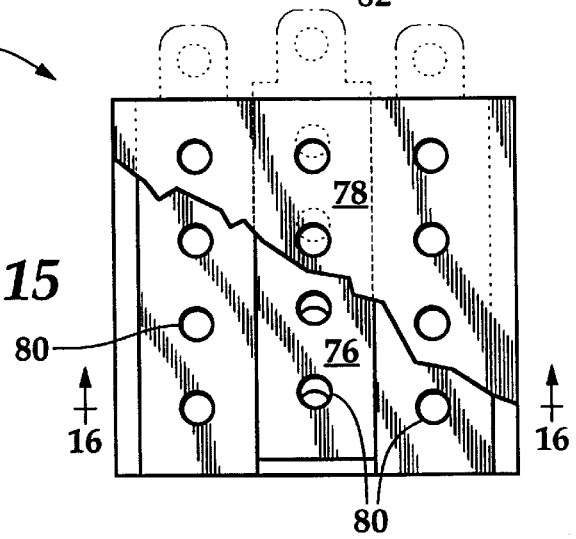
FIG. 15 is an elevational cross-sectional view of the headbox of FIG. 14 taken along line 15—15 in FIG. 16.
Figure 16:
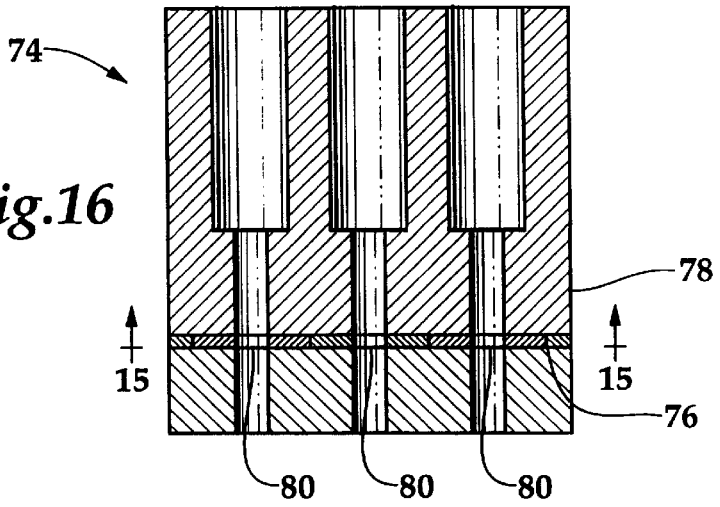
FIG. 16 is a plan cross-sectional view of the headbox of FIG. 15 taken along section line 16—16.

A further alternative valve 74 for use in a headbox is shown in FIG. 14. A plurality of guillotine valve plates 76 are positioned within a headbox structure 78. The guillotine valve plates 76 have a plurality of holes 80 which match with the tubes 82 of one or more columns of the tube bank. By moving the plates 76 as shown by arrow 84 in FIG. 14, the holes 80 can be moved so they do not completely line up with the tubes 82, thus partly blocking the tubes 82 as shown in FIGS. 14 and 15. Hydraulic, mechanical or electrical actuators (not shown) can be used to move the guillotine valve plates, up and down, to affect the desired level of flow from a column of tubes.

It should be understood that by controlling the flow in the cross machine direction, the design and manufacture of a headbox can be simplified because flow irregularities can be adjusted for by the valves 40, 56 or 74. This simplification of headbox design can lead to substantial cost reduction in headbox design.

It should be understood that the flow control valves can be used with or without profile control through stock injection of varying concentration along the discharge wall of the headbox. Further, although adjustment of the slice opening should not be required, slice opening could be simultaneously controlled, if additional control parameters are desired.

It is understood that the invention is not limited to the particular construction and arrangement of parts herein illustrated and described, but embraces such modified forms thereof as come within the scope of the following claims.

I claim:

1. A papermaking machine comprising:

a headbox supplying stock onto a forming fabric, wherein the headbox has a header and a slice chamber;

a tube bank composed of a multiplicity of tubes of uniform size each tube extending in a machine direction from the header along an outlet wall, to the slice chamber, the tubes forming a plurality of stacked rows each row having a multiplicity of tubes spaced in a cross machine direction, the stacked rows forming a multiplicity of tube columns, wherein portions of the headbox and each of the tubes of each tube column define a valve cavity, the tubes receiving a flow of stock from the header; and a valve for each tube column, and each tube in each tube column, the valves arrayed in the cross machine direction to control every tube of the tube bank, each valve having a valve control member extending into the valve cavity, wherein the valve control member has portions defining an opening for each tube, and wherein the valve control member is adjustable to selectably partially block the flow of stock through each tube in a selected column of tubes; and a controller controlling all of said valves, to control the fiber orientation in a forming web.

2. A papermaking machine comprising:

a headbox supplying stock onto a forming fabric, wherein the headbox has a header and a slice chamber;

a tube bank composed of a plurality of tubes, each tube extending in a machine direction from the header along an outlet wall to the slice chamber, the tubes forming a plurality of stacked rows, each row having a plurality of tubes spaced in a cross machine direction, the stacked rows forming a plurality of tube columns, wherein portions of the headbox and the tubes of each tube column define a valve cavity, the tubes receiving a flow of stock from the header;

a multiplicity of valves evenly arrayed in the cross machine direction, each valve having means for selectable blocking the flow of stock through a selected tube;

a fiber orientation sensor mounted to the papermaking machine downstream of the forming fabric for determining the orientation of fibers within the paper web as it is formed on the papermaking machine; and a controller in data-receiving relationship to the fiber orientation sensor, the controller controlling each valve to control the fiber orientation in a forming web, wherein the means for selectably blocking the flow through the tube comprises a guillotine valve plate which is movable to adjustably block flow through each tube in a column of tubes.

3. A headbox in a papermaking machine comprising:

a headbox having a header and a slice opening;

a discharge wall through which a plurality of tubes communicate with a slice chamber which empties through the slice opening, wherein the plurality of tubes are arrayed in columns of individual tubes which in turn are positioned in the cross machine direction to form an array of tubes; and a plurality of plates arrayed in the cross machine direction, each plate having a plurality of openings corresponding to each tube in a column of tubes, the plates positioned so that movement of the plates with respect to the headbox controls the flow of fluid through a column of tubes.

4. A papermaking machine comprising:

a headbox for supplying stock onto a forming fabric, wherein the headbox has a header and a slice chamber;

a tube bank composed of a plurality of tubes, each tube extending in a machine direction from the header along an outlet wall to the slice chamber, the tubes forming a plurality of stacked rows, each row having a plurality of tubes spaced in a cross machine direction, the stacked rows forming a plurality of tube columns, wherein portions of the headbox and the tubes of each tube column define means for controllably reducing the flow through at least one tube of each column, the tubes receiving a flow of stock from the header, so that the orientation of fibers in a web can be controlled across the entire machine direction of the web, wherein the means for controllably reducing the flow through the at least one tube of each column comprises a guillotine valve plate which is movable to adjustably block flow through each tube in a column of tubes.

5. A headbox and a papermaking machine comprising:

a plurality of tubes arranged in columns of individual tubes which in turn are positioned in the cross machine direction to form an array of tubes and through which a slurry of pulp flows;

a means for adjustably controlling the flow of slurry of pulp through substantially all of the tubes making up the tube array;

a fiber orientation sensor mounted to the papermaking machine downstream of the headbox for determining the orientation of fibers within a paper web as it is formed on the papermaking machine; and a controller in data-receiving relationship to the fiber orientation sensor, the controller controlling the means for adjustably controlling the flow of slurry of pulp, to control the fiber orientation in the forming web, wherein the means for adjustably controlling the flow through the tube comprises a guilloting valve plate which is movable to adjustably block flow through each tube in a column of tubes.

6. A headbox in a papermaking machine comprising:

a headbox having a header and a slice opening;

a discharge wall through which a plurality of tubes communicate with a slice chamber which empties through the slice opening, wherein the plurality of tubes are arrayed in columns of individual tubes which in turn are positioned in the cross machine direction to form an array of tubes; and a plurality of guillotine valve plates, one plate for each column of individual tubes of the plurality of tubes, the guillotine valve plates arranged to adjustably control the flow through substantially all of the tubes making up the tube array.

* * * * *